US005318368A

United States Patent [19]

Fogle et al.

[11] Patent Number: 5,318,368

[45] Date of Patent: Jun. 7, 1994

[54] THERMAL TRANSFER RIBBON HAVING RIBBON FOLLOWER

[75] Inventors: Ronald L. Fogle, Springboro; Lorraine T. Porter, Dayton; Larry D. Strausburg, Waynesville; Bruce E. Taylor, Tipp City, all of Ohio

[73] Assignee: Pitney Bowes Inc., Stamford, Conn.

[21] Appl. No.: 950,353

[22] Filed: Sep. 24, 1992

[51] Int. Cl.[5] ..... B41J 35/28

[52] U.S. Cl. ..... 400/208; 400/120

[58] Field of Search ..... 400/120, 194, 195, 196, 400/196.1, 208, 234, 235.1, 236; 346/1.1, 76 PH, 139

[56] References Cited

U.S. PATENT DOCUMENTS

| | | | |
|---|---|---|---|
| 3,921,518 | 11/1975 | Carnes, Jr. | 101/111 |
| 3,985,433 | 10/1976 | Calvi | 355/3 R |
| 3,998,542 | 12/1976 | Toto et al. | 355/16 |
| 4,265,550 | 5/1981 | Donnis et al. | 400/196 |
| 4,383,774 | 5/1983 | Yonkers | 400/195 |
| 4,723,853 | 2/1988 | Suzaki et al. | 400/120 |
| 4,767,228 | 8/1988 | Harry | 400/234 |
| 4,820,067 | 11/1989 | Surti | 400/208 |
| 4,878,773 | 11/1989 | Mazumder | 400/234 |
| 4,886,383 | 12/1989 | Mueller | 400/208 |
| 4,924,240 | 5/1990 | Herbert et al. | 346/1.1 |
| 4,926,193 | 5/1990 | Berson et al. | 346/76 PH |
| 4,966,476 | 10/1990 | Kuzuya et al. | 400/208 |
| 4,973,985 | 11/1990 | Genno et al. | 316/76 PH |
| 4,990,007 | 2/1991 | Schmidt et al. | 400/208 |
| 4,990,008 | 2/1991 | Hwang | 400/208 |
| 5,017,942 | 5/1991 | Asakura et al. | 400/208 |
| 5,033,888 | 7/1991 | Okumura et al. | 400/208 |
| 5,117,241 | 5/1992 | Stephenson | 346/1.1 |

*Primary Examiner*—Eugene H. Eickholt

*Attorney, Agent, or Firm*—Charles G. Parks, Jr.; Melvin J. Scolnick

[57] ABSTRACT

A thermal ribbon cassette includes a take-up spool and a supply spool rotatively mounted in the cassette housing. The spools are aligned to respective aperture in the rear wall of the housing. The housing has a print head opening located between the supply spool and the take-up spool dividing the cassette into the respective supply side and the take-up side. The thermal ink transfer ribbon supply is wrapped around the supply spool and extending to the take-up spool. An encoder post is rotatively mounted to the rear wall to the supply side of the cassette aligned to an aperture in the rear wall. A first drag post is fixably mounted to the rear wall on the supply side of the cassette and a feed post is fixably mounted to the rear wall on the supply side of the cassette just prior to the print head opening. A drag clutch is provided for preventing the supply spool from turning in the non-feed direction and for providing a predetermined amount of drag to the supply spool. The coefficients of friction and the relative location of the encoder post, drag post and feed post maintain the supply of the thermal ribbon taut.

3 Claims, 6 Drawing Sheets

THERMAL TRANSFER RIBBON HAVING RIBBON FOLLOWER

BACKGROUND OF THE INVENTION

The present invention relates to thermal printing systems and, more particular, to a thermal printing transfer ribbon cassette.

It is of particular interest to apply thermal printing techniques to postage meter printing and like applications. In order to apply thermal printing techniques to postage meter indicia printing there are basically two printing options. The first is to use a full matrix thermal print head to print the entire postage indicia simultaneously. A second option is to use a line matrix thermal print head. The use of a line matrix thermal print head for postage meter printing applications is preferred due to the reduced cost as compared against a full matrix thermal print head.

In order to use a line matrix thermal print head, it is considered advantageous to use thermal ribbon cassette in combination with a rotating platen. Generally, a suitable configuration includes a postage meter base having an envelope transport which include a rotatively driven platen. The line matrix thermal print head and thermal ribbon cassette are mounted to the base such that an envelope is captured between the platen roller and the thermal ribbon with the thermal print head serving as a backing. The platen roller applies a biasing force such that rotation of the platen roller cause the envelope to travel in the print direction.

In a novel thermal printing postage arrangement, the platen action is used to drive both the envelope and cassette ribbon past the thermal print head in this manner the opportunity for print smearing is minimized. In this configuration it is necessary to assure that the print ribbon remains taut in order to derive a thermal print divorced of any smears. Conventionally, the thermal ribbon cassette employes a spring loaded wheel which traps the ribbon against a stationary member. However, the conventional design can produce ribbon wrinkle.

SUMMARY OF THE INVENTION

It is an objective of the present invention to present a thermal tape cassette having a plurality of followers or posts uniquely positioned and having friction characteristic suitable to provide sufficient drag to the thermal tape and prevent wrinkling.

It is a further objective of the present invention to present a thermal ribbon drag post arrangement which is less distorting to the thermal ribbon of the thermal ribbon cassette during ribbon feeding.

It is a still further objective of the present invention to present a thermal ribbon drag post arrangement which incorporates fewer components and is easier to manufacture.

It is a further objective of the present invention to present a thermal tape cassette particularly suited for use in a thermal postage meter comprised of a number of modules or systems. Upon the placement of an envelope on the deck of the thermal printer by an operator, the envelope encounters a position sensing assembly which includes an envelope stop arrangement. The envelope stop arrangement prevents the envelope from being longitudinally mis-positioned. Upon proper positioning of the envelope on the deck, the position sensing assembly senses the presence of the envelope and informs a microcontroller to first duck the position sensing assembly out of the way, inclusive of the stop assembly, and initiate the print sequence. Upon initiation of the print sequence, a platen roller assembly is repositioned to bring the print area of the envelope into contact with the print ribbon of a ribbon cassette. The thermal print head of the postage meter is positioned as a backing to the print ribbon. The microcontroller drives a motor which in turns drives the platen roller. Rotation of the platen roller causes the envelope and cassette print ribbon to simultaneously traverse the print head while concurrently enabling the thermal print head. Following completion of the print cycle, the microcontroller causes the platen roller to be ducked below the deck and a pressure roller to be engaged for ejection of the envelope.

The tape cassette is comprised of a cassette housing having a drive spool. The drive spool has formed axially extending gear teeth. The drive spool is rotatively mounted by suitable conventional means in the cassette housing to be axially aligned to an opening in the rear wall of the housing. The gear teeth of the drive spool are configured to be mating to axial gear teeth formed on the periphery of the tape drive spool. In like manner to drive spool, the cassette housing includes supply spool having axial extending gear teeth rotatively mounted to the rear wall aligned to an opening in the rear wall. The gear teeth are configured to be mating to axial gear teeth formed on the periphery of the tape idle spool. An encoding post is rotatively mounted in the cassette rear wall, by any suitable conventional means, having a short shaft extending through the rear wall and into the aperture in the registration wall. A gear is fixably mounted to one end of the short shaft to be in constant mesh with the gear of the encoding assembly. A plurality drag post are mounted fixably in strategic locations by any conventional means to the cassette rear wall. The cassette housing further has a cassette opening and is mounted between upper clamp and lower clamp which extend from the registration wall.

DETAILED DESCRIPTION OF THE PREFERRED EMBODIMENT

Figure 1:
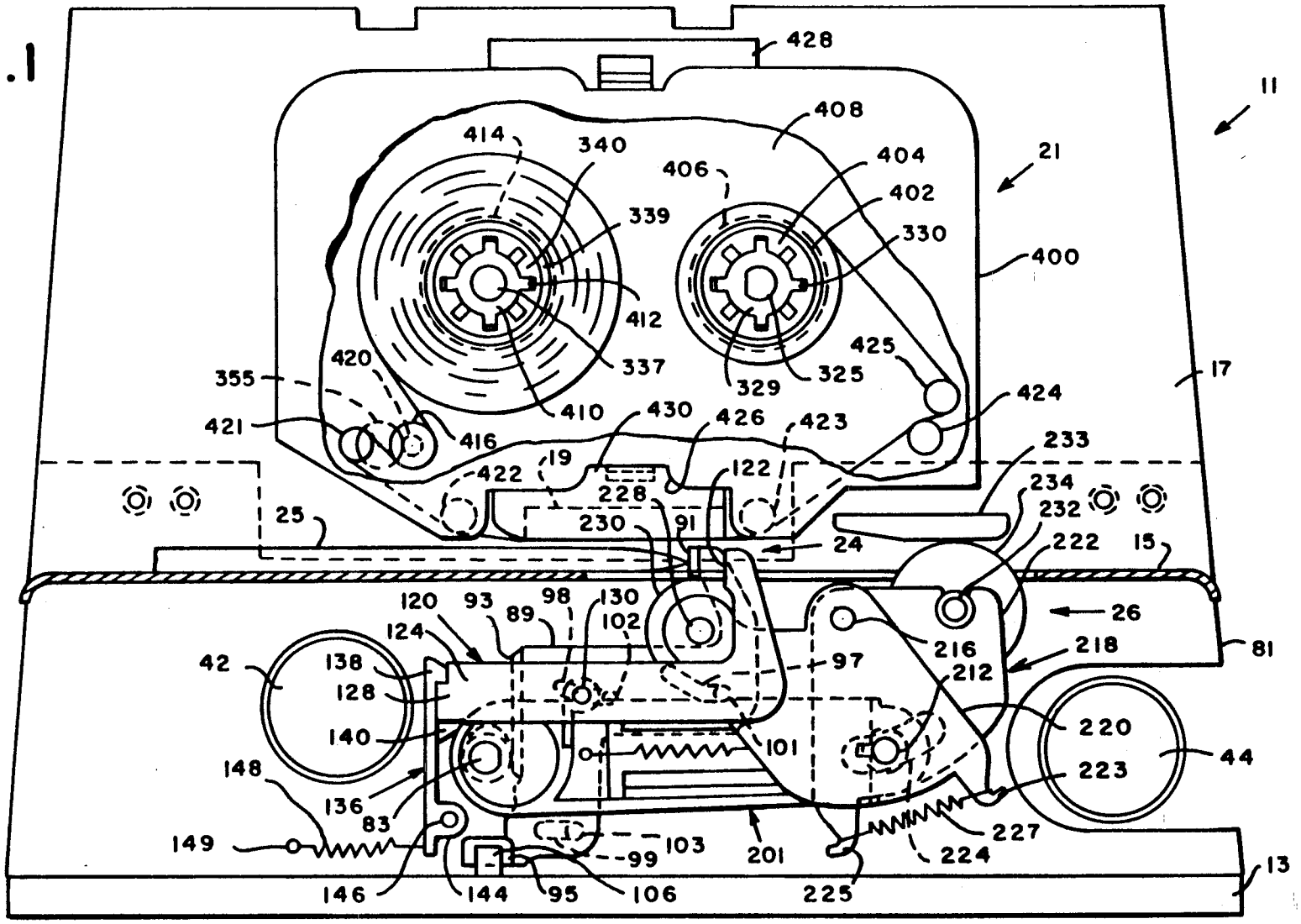
FIG. 1 is a partly section frontal view of a thermal postage meter and ribbon cassette in accordance with the present invention.

Referring to FIG. 1, a thermal postage meter, generally indicated as 11, includes a base 13 which supports a deck 15. The base 13 supports a registration wall 17, by any conventional means, to extend vertically upward from the deck. A thermal print head 19 is fixably mounted, by any conventional means, to the rear registration wall 17. The rear registration wall 17 has mounted thereto a thermal ribbon cassette 21. Mounted in the base 13 is a position sensing arrangement generally indicated as 24, for sensing the position of an envelope 25 transported along the deck 15 by a platen roller assembly, generally indicated as 26.

Figure 2:
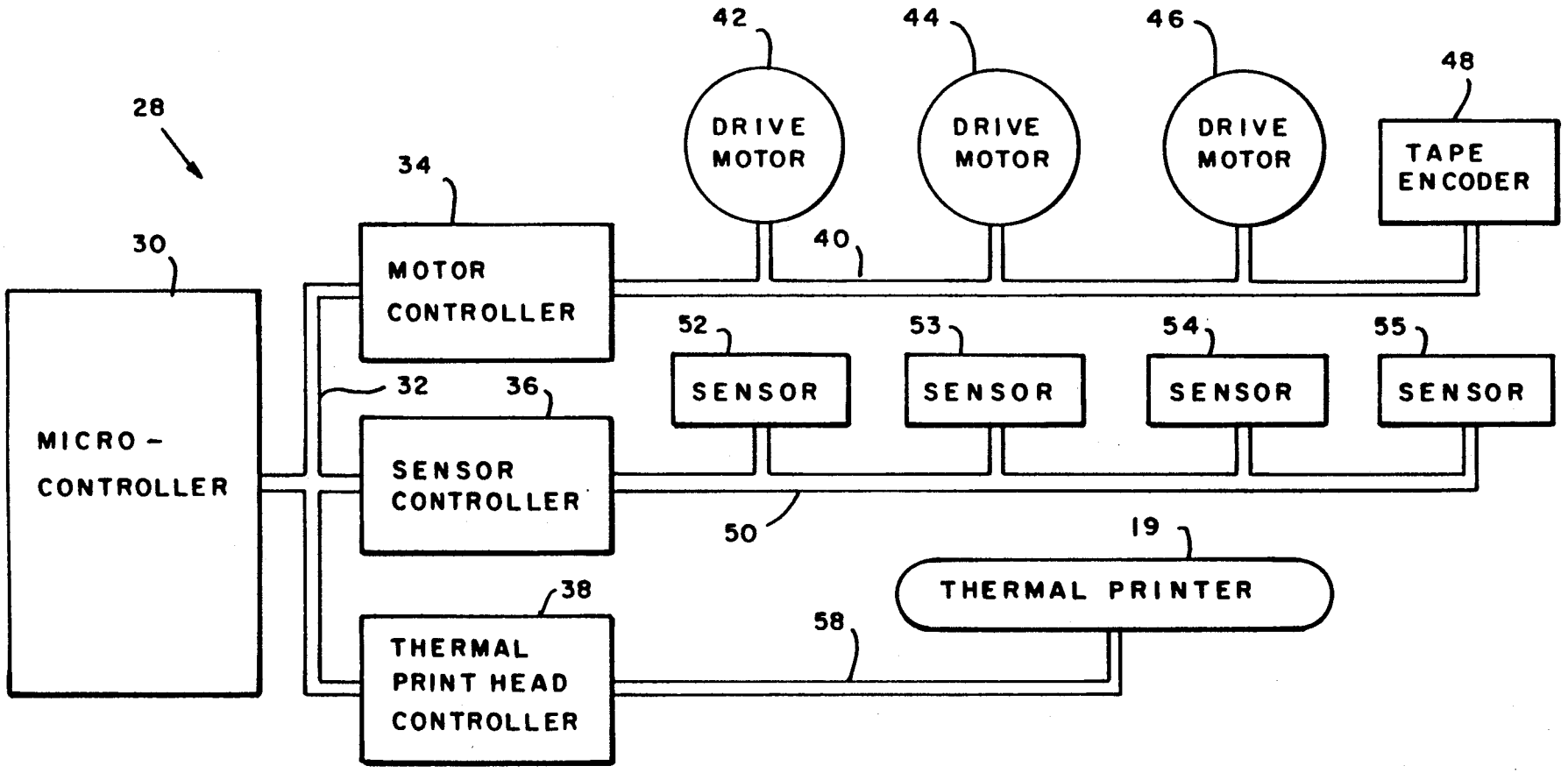
FIG. 2 is a schematic of a microcontroller in accordance with the present invention.

Referring to FIGS. 1 and 2, the thermal printing meter is under the influence of a system microcontroller, generally indicated as 28. The microcontroller system 28 is comprised of a programmable microcontroller 30 of any suitable conventional design, which is in bus 32 communication with a motor controller 34, a sensor controller 36, and the thermal print head controller 38. The motor controller 34, sensor controller 36 and thermal print head controller 38 may be of any suitable conventional design. The motor controller 34 is in motor bus 40 communication with a plurality of drive motors 42, 44 and 46. The motor control bus 40 also communicates the motor controller 34 to a tape encoder 48. The sensor controller 36 is in sensor bus 50 communication with a plurality of sensors 52–55 and the thermal printer controller 38 is in print head bus 58 communication with the thermal print head 19.

Figure 3:
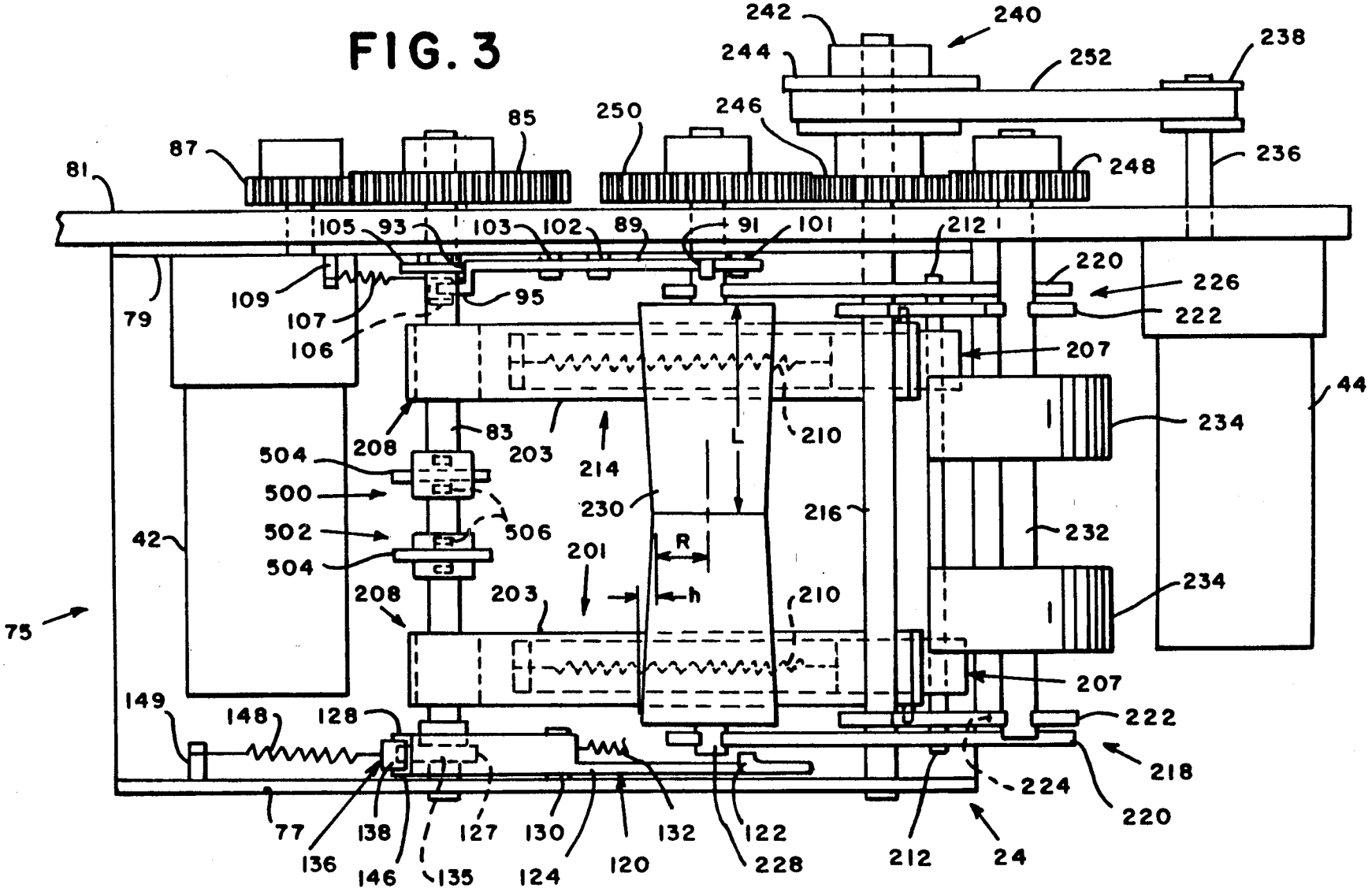
FIG. 3 is a sectioned top view of the thermal postage meter in accordance with the present invention.

Referring to FIGS. 1 and 3, the position sensing assembly 24 is comprised of a U-shaped support bracket 75 mounted to the base 13. The U-shaped support bracket 75 has a bracket forward wall 77 and a rear wall 79. Preferably, the bracket 75 is mounted to a base support wall 81 by any conventional means.

A shaft 83 is rotatively mounted to extend between the bracket walls 77 and 79 by any conventional means such as by a bearing assembly. A drive gear 85 is fixably mounted to the shaft 83 at one end. The motor 42 has a output gear 87 which is in constant mesh with the drive gear 85 for causing the shaft 83 to rotate under the influence of the motor 42. A position lever 89 which includes a envelope facing surface 91 is slidably mounted on the rear wall 79 of the bracket 75. A cam 105 is eccentrically mounted to the shaft 83 such that the camming periphery of the cam 105 is opposite the camming surface 93 of the position lever 89. A spring 107 is detachably mounted to the position lever at one end and to a formed tab 109 in the rear wall 79 at the other end. The spring biases the position lever 89 such that the camming surface 93 is biased against the cam surface of cam 105.

Mounted to the forward bracket wall 77 is an envelope stop lever 120. The stop lever 120 is pivotally mounted on a hub 130 which is formed in the forward bracket wall 77. A spring 132 which has one end attachably mounted to a tab 134 formed on the rearward bracket wall 77 and the other end attachably mounted to the collared tab 126 biases the camming surface 127 against the cam 105. A locking lever 136 which includes a locking tab 138 and 140 for securing the locking tab 128 of the envelope stop lever 20 between the locking tabs 138 and 140 of the locking lever 136. The locking lever 136 also includes a camming surface opposite the cam 105. A spring 148 which is detachably mounted at one end to a tab 149 and at its other end to the envelope stop lever 120 is mounted for biasing the locking lever 136 in the direction of the cam 105.

Still referring to FIGS. 1 and 3, the platen roller assembly 26 includes a linking arm assembly 201 comprising a first link section 208 and second link section 203. One end of the first linking section 208 is eccentrically mounted around the shaft 83. A spring 210 having its respective ends detachably mounted in the first and second sections of the linking arm 203 and 207, respectively, biases the second section 207 within the receiving channel of the first link section 203. The exposed end of the second section 207 includes a hub 212. A second linking arm assembly 214 is constructed identical to the linking assembly 201 and is eccentrically mounted in cooperative alignment with the linking arm assembly 201 on the shaft 83.

A pivot link assembly, generally indicated as 218, is mounted to a shaft 216 which is rotatively mounted between the rearward and forward bracket walls 77 and 79, respectively. The pivot link assembly 218 includes a first link plate 220 pivotally mounted around shaft 216 at one point and pivotally mounted around the hub 212 at another point. A second link plate 222 is pivotally mounted around the shaft 216 at one point and includes a slot 224 wherein the hub 212 rides therein. A spring hook 223 is formed in the first link plate 220 and a spring hook 225 is formed in the second link plate 222. A spring 227 has its respective ends fastened around the respective spring hooks 223 and 225 in a conventional manner. A second pivot link assembly 226, identical to the pivot link assembly 218, is pivotally mounted to the shaft 216 in spaced apart relationship to the pivot link assembly 218. A platen module 228 is rotatively mounted by any conventional means to the link plates 220 of the respective pivot link assemblies, 218 and 226. A platen roller 230 is fixably mounted around the platen roller shaft 228, between the pivot link assemblies, 218 and 226.

A pressure roller shaft 232 is rotatively mounted by any conventional means to the link plates 222 of the respective pivot link assemblies 218 and 226. Pressure rollers 234 are fixably mounted around the pressure roller shaft 232 in spaced apart relationship. The pressure rollers 234 are aligned generally opposite a backing member fixably mounted on the registration wall 17 and extending laterally therefrom. A drive shaft 236 having a spool 238 fixably mounted to one end is responsive to the motor 44. A spool gear arrangement 240 which includes a hub 242 rotatively mounted around the shaft 216, a spool 244 fixably mounted to the hub 242 and a gear 246 also fixably mounted to the hub 242. A gear 248 is fixably mounted to the shaft 232 and a gear 250 is fixably mounted around the shaft 228. The gears 246 is constant mesh with gear 248 and 240, and an endless belt 252 extends around the spools 238 and 244.

Figure 4:
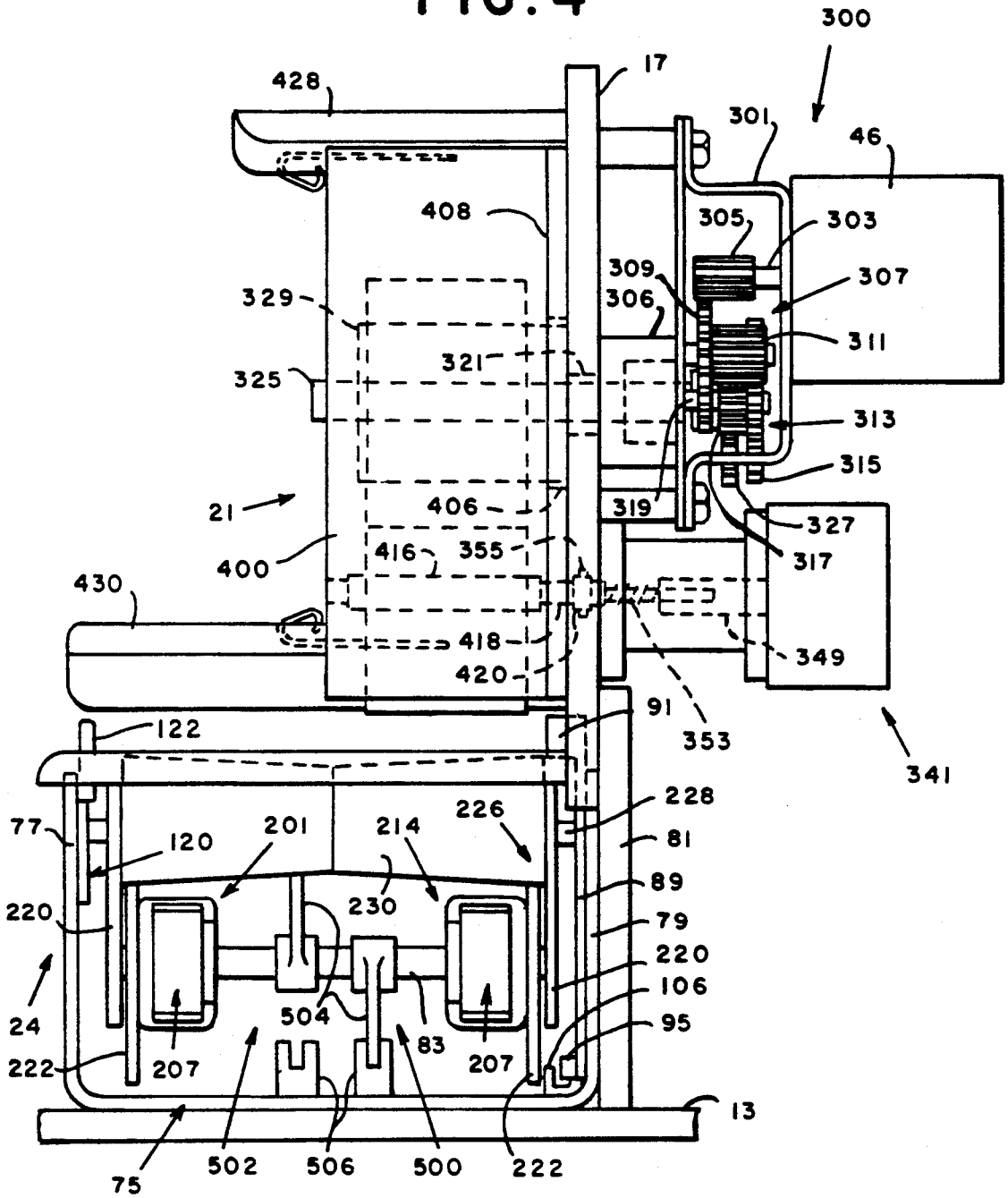
FIG. 4 is a sectioned end view of the thermal postage meter in accordance with the present invention.

Referring to FIGS. 1 and 4, a thermal drive cassette assembly, generally indicated as 300, is comprised of a mounting platform 301 of any suitable construction. The mounting platform 301 is fixably mounted, by any conventional means, to the back side of the registration wall 17. A tape motor 46 is fixably mounted to the mounting platform 301, by any suitable conventional means. The output shaft 303 of the drive motor 46 has a drive gear 305 fixably mounted to the output shaft 303 of the drive motor 46. A conventional double gear set 307 having a first gear 309 in constant mesh with the drive gear 305 and a second gear 311 rotatively mounted to the back side of the registration wall 17. A conventional double idle gear set 313 having first gear 315 in constant mesh with the gear 311 and a second gear 317 is rotatively mounted by any conventional means to a gear hub 319. The gear hub 319 is fixably mounted to the mounting platform 301 by any conventional means and rotatively supports the idle gear set 313 by any suitable conventional means. A registration wall aperture 312 is formed in the registration wall 17. A conventional bearing hub assembly 323 is fixably mounted to the back side of the registration wall 17 aligned to the aperture 312. A tape drive shaft 325 extends through the aperture 312 rotatively supported by the bearing hub assembly 323. A gear 327 is fixably mounted by any conventional means to one end of the tape drive shaft 325 in constant mesh with the gear 317. A tape drive spool 329 is fixably mounted by any conventional means around a portion of the tape drive shaft 325.

A tape supply assembly, generally indicated as 331, is mounted to the back side of the registration wall 17 aligned to a registration wall aperture 333. The tape supply assembly 331 includes a conventional one way friction clutch and shaft assembly 335 of any suitable construction fixably mounted to the back side of the registration wall 17 aligned to the aperture 333. The assembly 335 includes an supply shaft 337 extending through the aperture 333. A tape supply spool 339 is fixably mounted by any conventional means around a portion of the supply shaft 337.

An encoding assembly, generally indicated as 341, is fixably mounted to a mounting spindle 343 which is fixably mounted to the back side of the registration wall 17, by any suitable conventional means, aligned to a registration wall aperture 345. The encoding assembly 341 includes collar 347 and a input shaft 349. A mating male shaft 351 is received by the shaft 349 such that the male shaft 351 can experience limited axially displacement within the shaft 349 and such that the male shaft rotatively drive the shaft 349 such as by any suitable conventional mating longitudinal gears arrangement or single shaft arrangement. A spring 353 is placed around the shaft 351 and an end cap gear 355 is fixably mounted by any conventional means to the shaft 351 within the aperture 345.

The tape cassette 21 is comprised of a cassette housing 400 having a drive spool 402. The drive spool has formed axial extending gear teeth 404. The drive spool 404 is rotatively mounted by suitable conventional means in the cassette housing 400 to be axially aligned to a opening 406 in the rear wall 408 of the housing 400. The gear teeth 404 of the drive spool 402 are configured to be mating to axial gear teeth 330 formed on the periphery of the tape drive spool 329. In like manner to drive spool 402, the cassette housing includes supply spool 410 having axial extending gear teeth 412 rotatively mounted to the rear wall 408 aligned to an opening 414 in the rear wall 408. The gear teeth 412 are configured to be mating to axial gear teeth 340 formed on the periphery of the tape supply spool 339. An encoding post 416 is rotatively mounted in the cassette rear wall 408, by any suitable conventional means, having a short shaft 418 extending through the rear wall 408 and into the aperture 345 in the registration wall 17. A gear 420 is fixably mounted to one end of the short shaft 418 to be in constant mesh with the gear 355 of the encoding assembly 341. A plurality drag post 421, 422, 423, 424 and 425 are strategically mounted fixably by any conventional means to the cassette rear wall 408. The cassette housing 400 further has a cassette opening 426 and is mounted between upper clamp 428 and lower clamp 430 which extend from the registration wall 17. In the preferred embodiment, the following dimensions are observed within the thermal ribbon cassette.

| | |
|---|---|
| encoder post | polyurethane having a coefficient of friction of 1.5 or greater, |
| first drag post | surface coefficient of friction of between 0.2 and 0.5, |
| feed post | a surface coefficient of friction of between 0.2 and 0.5. |
| angle between first drag post and encoder post is set at a horizontal angle between 0 degrees and 5 degrees | |
| angle between feed post and first drag post is set at between 30 degrees and 45 degrees | |

Figure 5:
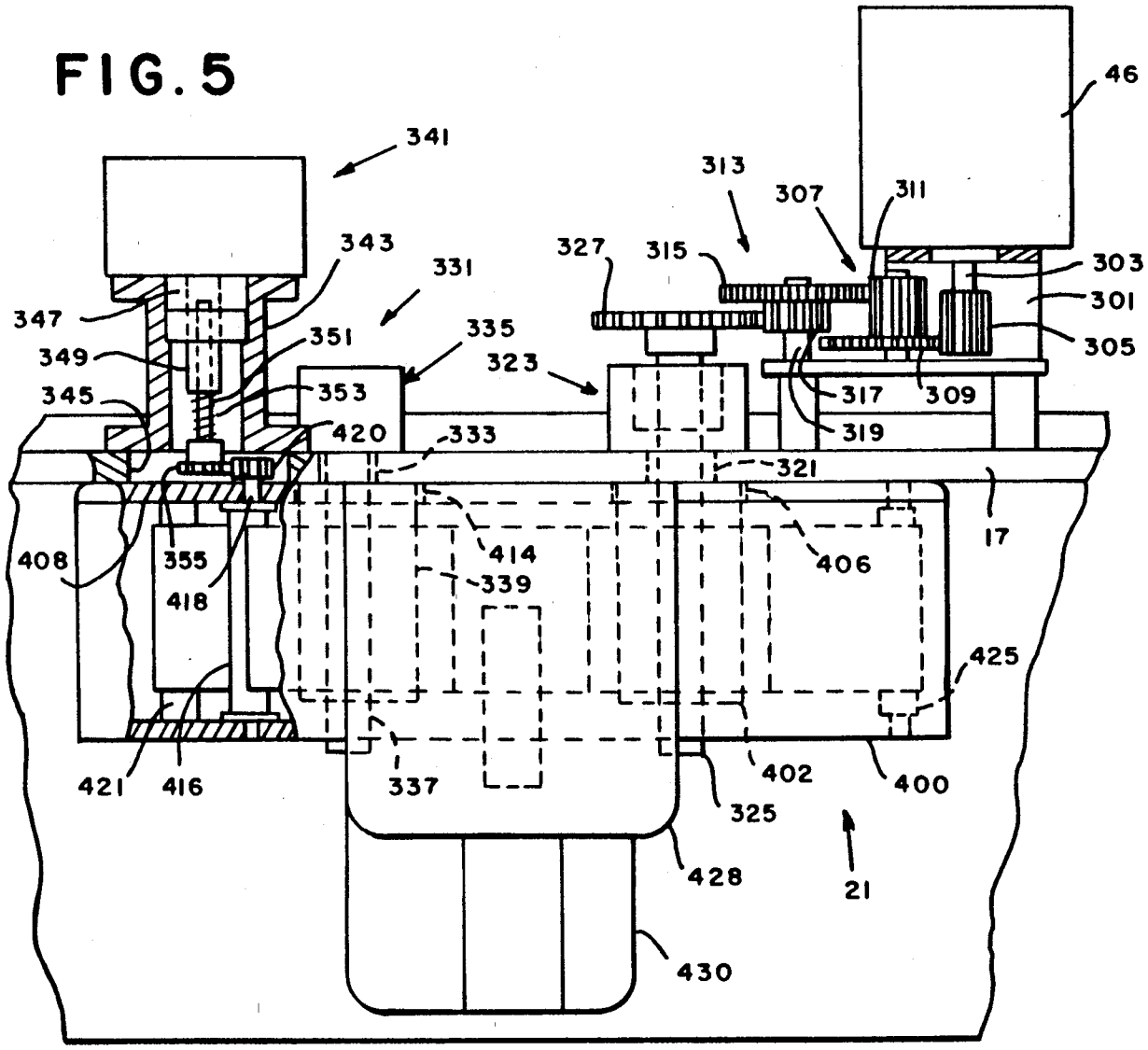
FIG. 5 is a sectioned top view of the thermal postage meter and cassette in accordance with the present invention.
Figure 6:
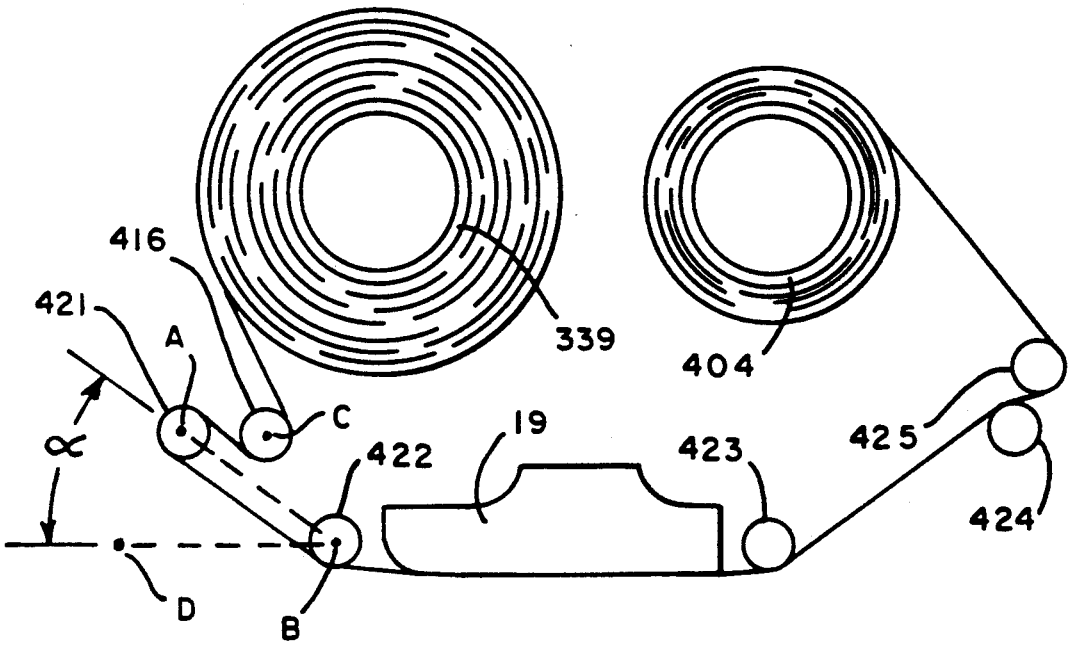
FIG. 6 is a schematic diagram of the thermal ribbon cassette post position in accordance with the present invention.

Referring particularly to FIGS. 1 and 5, the function of the thermal postage meter 11 is to accept an envelope 25, print an indicia using thermal transfer print technology, and eject the envelope 25 from the printer. The feed direction of the printer is from left to right. The function of the platen roller 230 is to feed the envelope at a constant rate and to supply the print head pressure needed to transfer the thermal ink from the ribbon. As the platen 230 feeds the envelope through the print nip, it also feeds the thermal transfer ribbon. Therefore, use of the platen roller 230 for ejection would lead to wasted ribbon. A separate ejection roller 234 is used to feed the envelope out of the printer after printing.

The thermal transfer ribbon feeds around a urethane wrapped encoder roller 416 inside the cassette (refer to FIG. 5). As the ribbon feeds, the friction of the ribbon against the encoder roller 416 causes it to turn. The encoder roller gear 420 which protrudes from the back side of the cassette and couples with a mating gear 355 in the printer. The mating gear 355 turns an optical encoder 341 which is used to monitor ribbon motion.

Once the platen roller 230 has fully engaged the envelope 25, the motor 44 and the ribbon drive motor 46 are started. Note that the motor 44 turns both the platen roller 230 and the ejection rollers 234. However, the ejection roller 234 are not in the supply path so it has no affect on the envelope 25. The envelope 25 and cassette ribbon begin to feed and are brought up to speed. Printing then starts by loading data to the print head at a constant rate from the microcontroller 30 through the print head controller 38. The speed is monitored and controlled through the encoder (not shown) on the motor 44. In the preferred embodiment of the present invention, the printing operation takes about 425 mS.

While printing, the ribbon is driven through the print nip by the motion of the envelope 25. The ribbon take-up motor 46 winds up the ribbon on the take-up core and provides even tension without pulling the ribbon through the print nip. In order to provide the even tension desired, the back EMF of the motor 46 is monitored. Changes in the back EMF indicate quantity of ribbon and the ribbon drive is modified accordingly. In addition, a sharp change in the back EMF of the motor indicates that the ribbon is broken after the print head or the ribbon has stopped.

Tension on the supply side of the print nip must also be maintained. The ribbon is fed through a series of posts 416, 421, 422, 423, 424 and 425 (post 416 being the encoder roller which provides drag to the ribbon through the friction of the ribbon against the posts). A light clutch load is provided by the clutch 335 on the ribbon supply core to provide tighter wrap of the ribbon around the post. The ribbon encoder 341 is turned by the friction of the ribbon moving past the roller 416. The encoder motion is monitored by the microcontroller 30 to determine if the ribbon breaks before reaching the print head or if the ribbon runs out. In addition, the encoder can be used to monitor the speed of the ribbon, and therefore the envelope, through the print nip.

When printing has been completed, the shaft 83 rotates 180 degrees back to its original home position. The drive link 201 and 214 becomes a solid assembly which pushes the ejection roller 234 against the envelope 25. Since a lighter load is needed for ejection than for printing, the spring 227 becomes the only active spring. The motor 44 continues to drive both rollers 230 and 234. At this point, however, the platen roller 230 becomes inactive because it is below the feed deck. At the same time, the ribbon motor 46 is stopped. When the ejection roller 234 engages, it feeds the envelope 25 from the printer at 2 to 3 times the print speed in the preferred. Once the envelope 25 clears the print nip, the stop and trip levers 120 and 89, respectively, return to their home position. The drive motor 44 is stopped and the process is complete.

The above description describes the preferred embodiment of the invention and should not be viewed as limiting. The scope of the invention is set forth in the appendix claims.

What is claimed is:

1. An improved thermal ribbon cassette, said thermal ribbon cassette having a housing with a rear wall, a take-up spool and a supply spool rotatively mounted in said housing, said supply spool to rotate in a first feed direction and said spools being aligned to respective apertures in the rear wall of said housing, said housing having a print head opening located between said supply spool and said take-up spool dividing said cassette into said respective supply side and said take-up side, and a thermal ink transfer ribbon wrapped around said supply spool and extending to said take-up spool, wherein said improvement comprises:

an encoder post rotatively mounted to said rear wall to the supply side of the cassette and being aligned to a aperture in said rear wall:

a first drag post fixably mounted to said rear wall on the supply side of the cassette;

a feed post fixably mounted to said rear wall on the supply side of said cassette just prior to said print head opening;

means for preventing said supply spool from turning in other than the feed direction and for providing a predetermined amount of additional drag to said supply spool;

said encoder post having a surface coefficient of friction of 1.5 or greater;

said first drag post having a surface coefficient of friction of between 0.2 and 0.5;

said feed post having a surface coefficient of friction of between 0.2 and 0.5; and, said thermal ribbon being threaded between said respective posts.

2. An improved thermal ribbon cassette as claimed in claim 1 wherein said first drag post is set at a horizontal angle between 0 degrees and 5 degrees to said encoder post.

3. An improved thermal ribbon cassette as claimed in claim 2 wherein said feed post is set at a horizontal angle between 30 degrees and 45 degrees to said first drag post.

* * * * *